US011440722B2

(12) United States Patent
carlos-wallace

(10) Patent No.: US 11,440,722 B2
(45) Date of Patent: Sep. 13, 2022

(54) CANNABIS STORAGE CONTAINER (CANNATAINER/CANNASCAPE)

(71) Applicant: Christopher carlos-wallace, El sobrante ca, CA (US)

(72) Inventor: Christopher carlos-wallace, El sobrante ca, CA (US)

(73) Assignee: Christopher Carlos-Wallace, El Sobrante, CA (US)

( * ) Notice: Subject to any disclaimer, the term of this patent is extended or adjusted under 35 U.S.C. 154(b) by 0 days.

(21) Appl. No.: 17/074,487

(22) Filed: Nov. 23, 2020

(65) Prior Publication Data

US 2022/0002064 A1 Jan. 6, 2022

Related U.S. Application Data

(60) Provisional application No. 63/047,866, filed on Jul. 2, 2020.

(51) Int. Cl.
*B65D 81/20* (2006.01)
*A24F 23/00* (2006.01)

(52) U.S. Cl.
CPC ..... *B65D 81/2038* (2013.01); *A24F 23/00* (2013.01); *B65D 81/2076* (2013.01)

(58) Field of Classification Search
CPC ..... B65D 81/20; B65D 81/2007; B65D 81/2038; B65D 81/2076; A24F 23/00
USPC ..... 206/248, 260, 265, 524.8; 215/260, 262, 215/228
See application file for complete search history.

(56) References Cited

U.S. PATENT DOCUMENTS 4,093,009 A * 6/1978 Iavarone ..... B65D 81/2038 206/524.8
5,145,077 A * 9/1992 Rohrig ..... A61J 9/00 215/11.1
5,628,404 A * 5/1997 Hendrix ..... B65D 25/16 206/524.8
8,967,412 B2 * 3/2015 Loging ..... A47G 19/2272 215/11.4
2005/0035021 A1 * 2/2005 Higer ..... B65D 81/2015 206/524.8
2006/0144726 A1 * 7/2006 Foust ..... B65D 43/162 206/204
2006/0213802 A1 * 9/2006 Poo ..... B65D 81/20 206/524.8
2007/0095712 A1 * 5/2007 Miles ..... B65D 81/127 206/524.8
2007/0228051 A1 * 10/2007 Meroni ..... B65D 81/2038 220/580
2020/0377280 A1 * 12/2020 Pace ..... B65D 50/041

* cited by examiner

*Primary Examiner* — Luan K Bui
(74) *Attorney, Agent, or Firm* — Squire Patton Boggs (US) LLP

(57) ABSTRACT

Described herein is an apparatus for air-tight storage and preservation of cannabis. In embodiments, the apparatus includes a silicone compressor operable to reduce a volume of air within an interior of a container of the apparatus, a childproof cap, UV tinted glass, and a storage bag that is porous to allow for transmission of gasses therethrough. The silicone compressor includes an input pinhole for injecting inert gases into an interior of the container and an output valve through which internal oxygen can escape as the volume of air is being reduced.

5 Claims, 16 Drawing Sheets

CANNABIS STORAGE CONTAINER (CANNATAINER/CANNASCAPE)

CROSS-REFERENCE TO RELATED APPLICATIONS

The present application claims the priority benefit of U.S. Provisional Application Ser. No. 63/047,866, titled Cannabis Storage Container, filed Jul. 2, 2020, the disclosure of which is incorporated by reference herein in its entirety.

FIELD OF THE INVENTION

The invention relates generally to a storage container having particular use in storing and preserving cannabis.

BACKGROUND

Currently there are a number of solutions for preserving cannabis. One of these solutions attempts to utilize a Ziploc bag, but this solution fails to meet the needs of the market because it does not generally provide an odor free and sealed reusable container. Another solution attempts to utilize glass jars, but this solution is similarly unable to meet the needs of the market because it does not have an assembly configured to remove air from within the jar interior. Still another solution seeks to vacuum a sealed container, but this solution also fails to meet market needs because a user may not have the equipment to vacuum seal the container.

SUMMARY OF THE INVENTION

It would be advantageous to have an apparatus for the storage and preservation of cannabis that is airtight. Furthermore, it would also be advantageous to have an apparatus for the storage and preservation of cannabis that is child-proof. Still further, it would be advantageous to have an apparatus comprised of a container that is tinted so as to act as a filter that blocks ultraviolet (UV) light from entering into an interior of said container. It would still further be advantageous to have an apparatus comprised of a container in which a volume of air within an interior of said container is capable of being reduced. Therefore, there currently exists a need in the market for an apparatus for the storage and preservation of cannabis that overcomes the aforementioned deficiencies.

The present invention advantageously fills the aforementioned deficiencies by providing an apparatus and a storage container specially adapted for the storage of cannabis, which provides for the long-term preservation of cannabis.

In one aspect, the invention provides a container for the storage and preservation of cannabis, the container comprising a compressor portion configured with a size and a shape corresponding to an interior dimension of the container. In embodiments, the compressor portion is housed within an interior of the container, and is operable to reduce a volume of air within the interior between a bottom of the container and the compressor portion. In embodiments, the container comprises a top portion configured for removable receipt of a cap. In embodiments, the compressor portion further comprises an input pinhole for injection of an inert gas into the interior of the container between the bottom of the container and the compressor portion. In embodiments, the compressor portion further comprises an output valve through which air within said interior between bottom of said container and the compressor portion can escape as the volume of air is being reduced.

In embodiments, the container is an air-tight cannabis storage and preservation container.

In embodiments, the cap comprises a childproof cap.

In embodiments, the container is comprised of a glass material. In embodiments, the glass material is tinted so as to block UV light from entering into an interior of the container.

In embodiments, the container further comprises a temperature strip positioned on an exterior portion of the container, capable to display an internal temperature of the container.

In embodiments, the compressor portion is comprised of silicone.

In another aspect, the invention provides a cannabis storage apparatus for airtight storage and preservation of cannabis. In embodiments, the apparatus comprises a cylindrical glass container that includes a silicone compressor portion of a size and a shape corresponding to an interior dimension of the cylindrical glass container. In embodiments, the compressor portion is housed within an interior of the cylindrical glass container, and is operable to reduce a volume of air within the interior between a bottom of the cylindrical glass container and the compressor portion.

In embodiments, the compressor portion comprises an input pinhole for injection of an inert gas into the interior of the cylindrical glass container between the bottom of the cylindrical glass container and the compressor portion, and an output valve through which air within the interior between the bottom of the cylindrical glass container and the compressor portion can escape as the volume of air is being reduced.

In embodiments, the apparatus includes an internal storage bag that is porous to allow for transmission of gasses therethrough.

In embodiments, the apparatus has a nitrogen infusing hose and nozzle for injection of nitrogen into the interior of the cylindrical glass container between the bottom of the cylindrical glass container and the compressor portion.

In embodiments of the apparatus, the cylindrical glass container further comprises a top portion configured for removable receipt of a cap. In embodiments, the cap comprises a child-proof cap.

In embodiments of the apparatus, the cylindrical glass container is tinted for blockage of UV light from entering the interior of the cylindrical glass container.

In embodiments, the apparatus further comprises a temperature strip positioned on an exterior portion (e.g., on a front) of the cylindrical glass container for displaying to a user an internal temperature of the cylindrical glass container.

In embodiments, the apparatus fulfills the need for storing and preserving cannabis, including long-term preservation of cannabis.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Following are more detailed descriptions of various related concepts related to, and embodiments of, the cannabis container and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

As mentioned, the invention is an improved storage container and apparatus specifically adapted with features for the storage of cannabis.

In particular embodiments, the invention is a childproof, airtight, cannabis preserving container.

Turning now to the figures, FIGS. 1-16 illustrate various embodiments of the apparatus of the present disclosure, including a cannabis storage container and associated materials.

Figure 1:
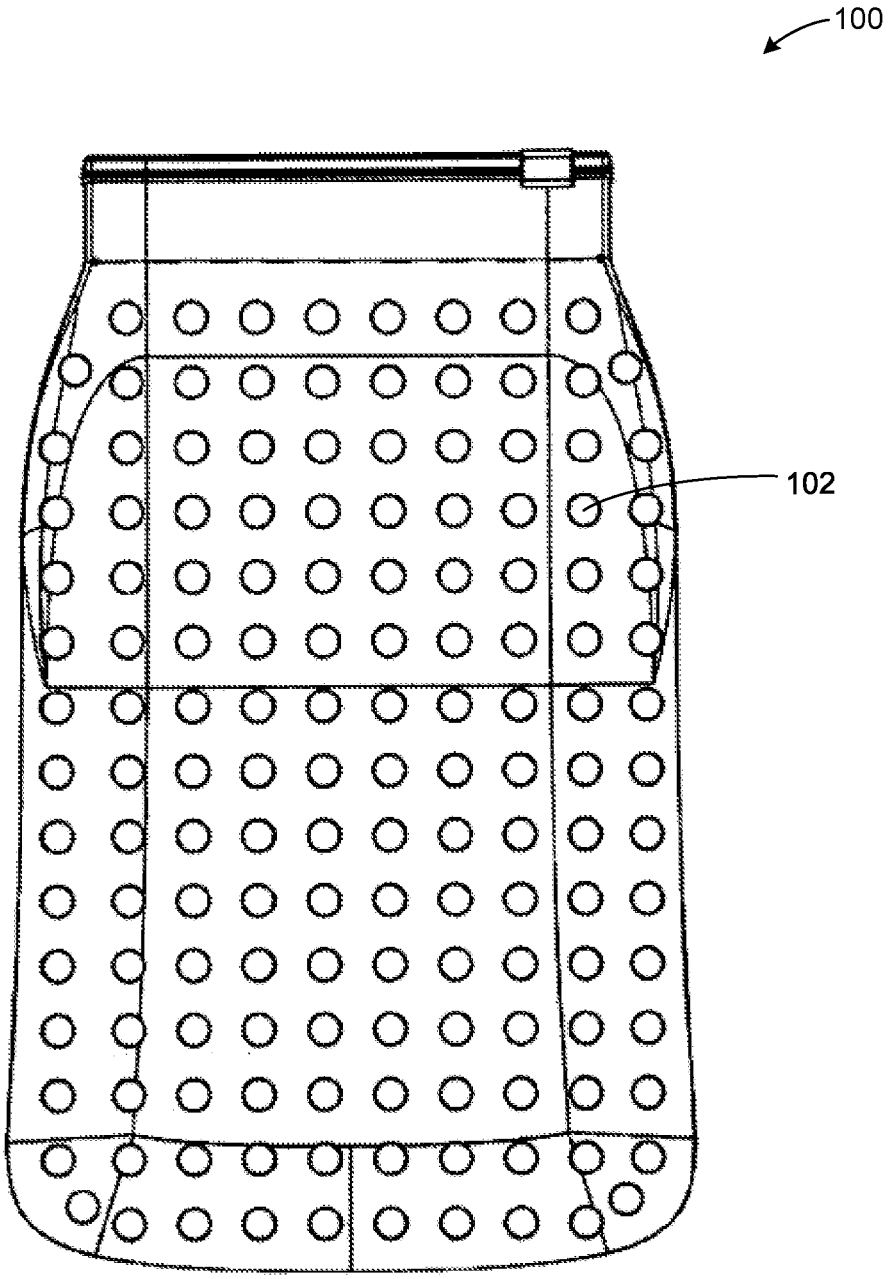
FIG. 1 shows the front of a porous bag according to embodiments of the present disclosure.
Figure 2:
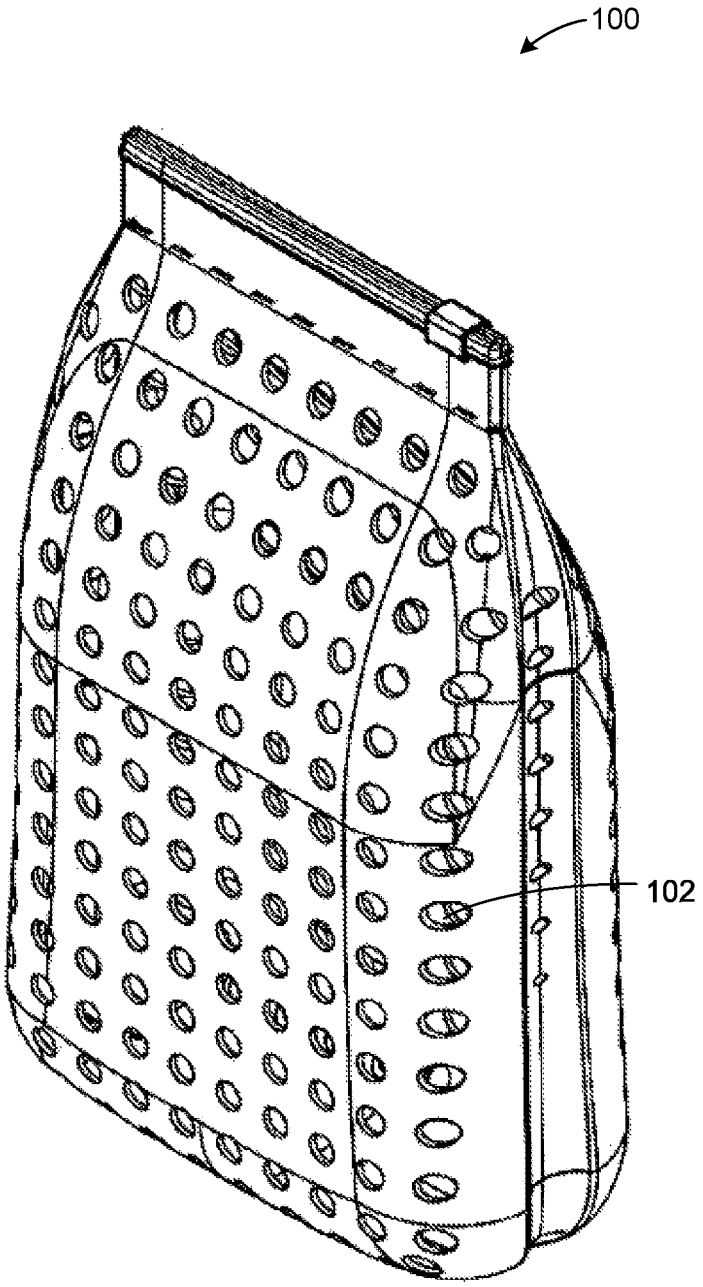
FIG. 2 shows a perspective view of the porous bag of FIG. 1.
Figure 3:
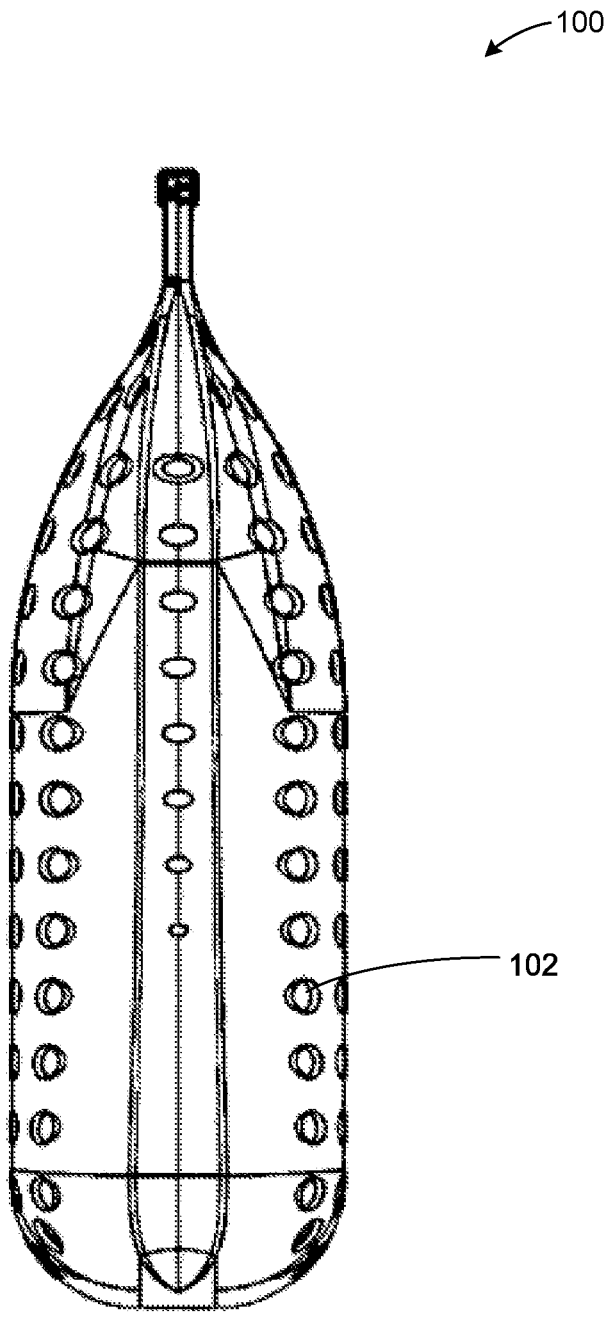
FIG. 3 shows a side view of the porous bag of FIGS. 1-2.
Figure 4:
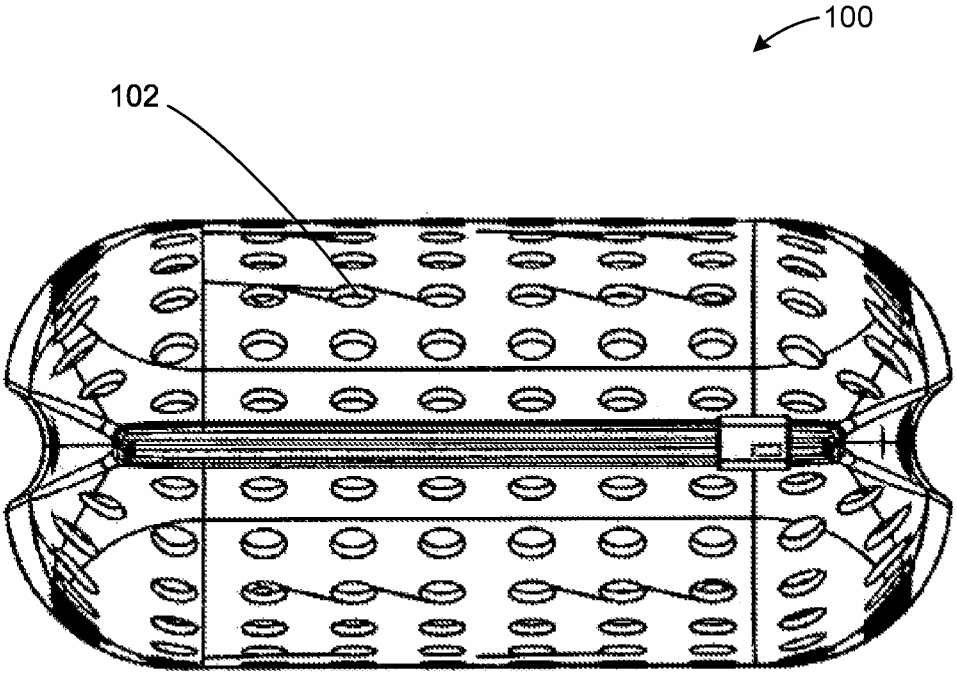
FIG. 4 shows a top view of the porous bag of FIGS. 1-3.

FIG. 1 illustrates a bag 100 for use with the apparatus and storage container of the present disclosure as viewed from a front of the bag. As shown, bag 100 includes a plurality of pores 102 to allow for transmission of gasses between the bag and an interior of a cannabis container of the present disclosure. Thus, it is to be understood that bag 100 can be included in the interior of a cannabis container of the present disclosure. The porous nature of the bag can allow for displacement of air, for example displacement of air with an inert gas. FIGS. 2-4 depict additional views of bag 100 for reference.

Figure 5:
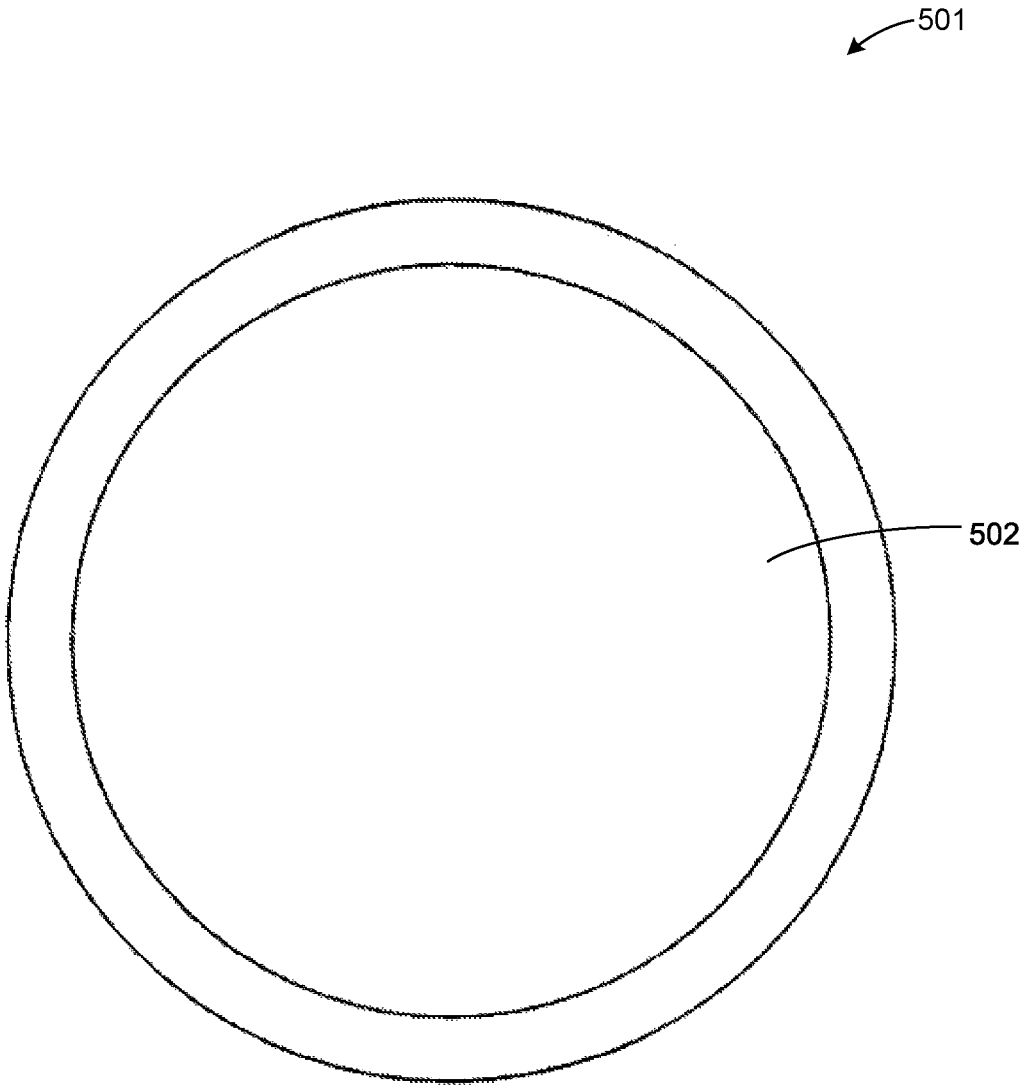
FIG. 5 shows the bottom of a cannabis container of the present disclosure.
Figure 6:
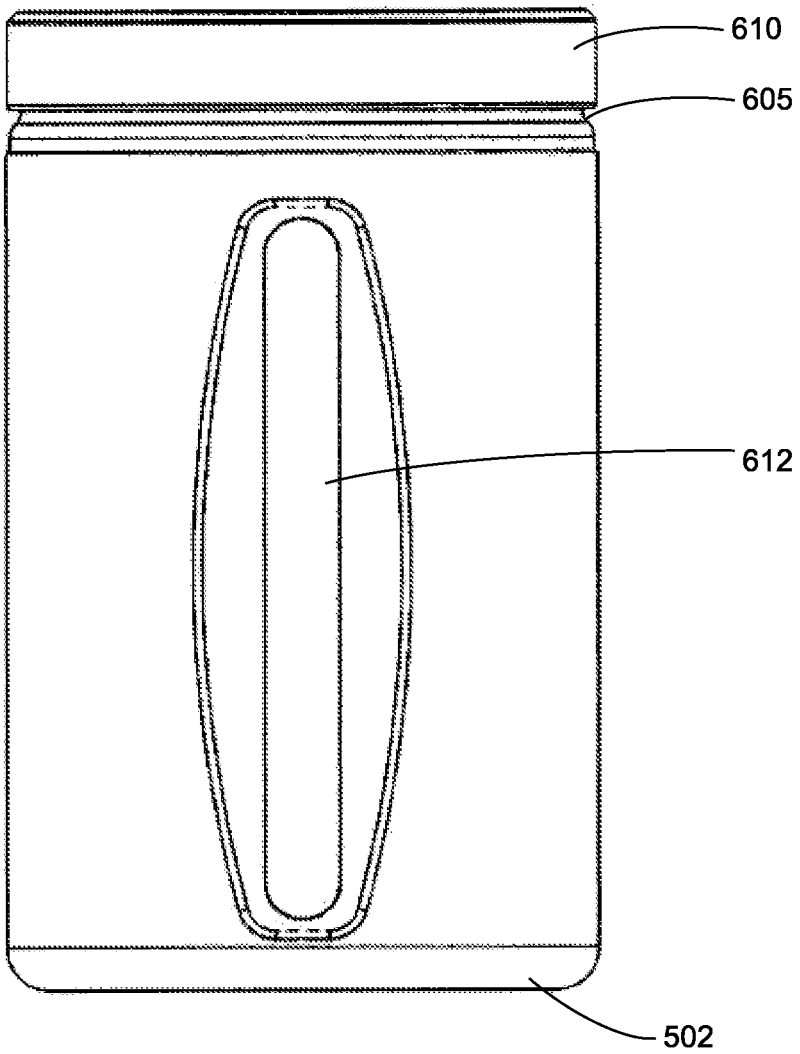
FIG. 6 shows a front view of the cannabis container of FIG. 5.

FIGS. 5-10 depict various views of embodiments of a cannabis container of the present disclosure. In the embodiments, the cannabis container is cylindrical. Turning to FIG. 5, depicted is a view of a bottom 502 of cannabis container 501. Turning to FIG. 6, depicted is a front view of cannabis container 501 illustrating bottom 502, top portion 605, and cap 610. Also shown at FIG. 6 is temperature strip 612. In embodiments, temperature strip 612 is positioned on the front of cannabis container 501, to provide a user with an indication of an internal temperature of cannabis container 501.

Figure 7:
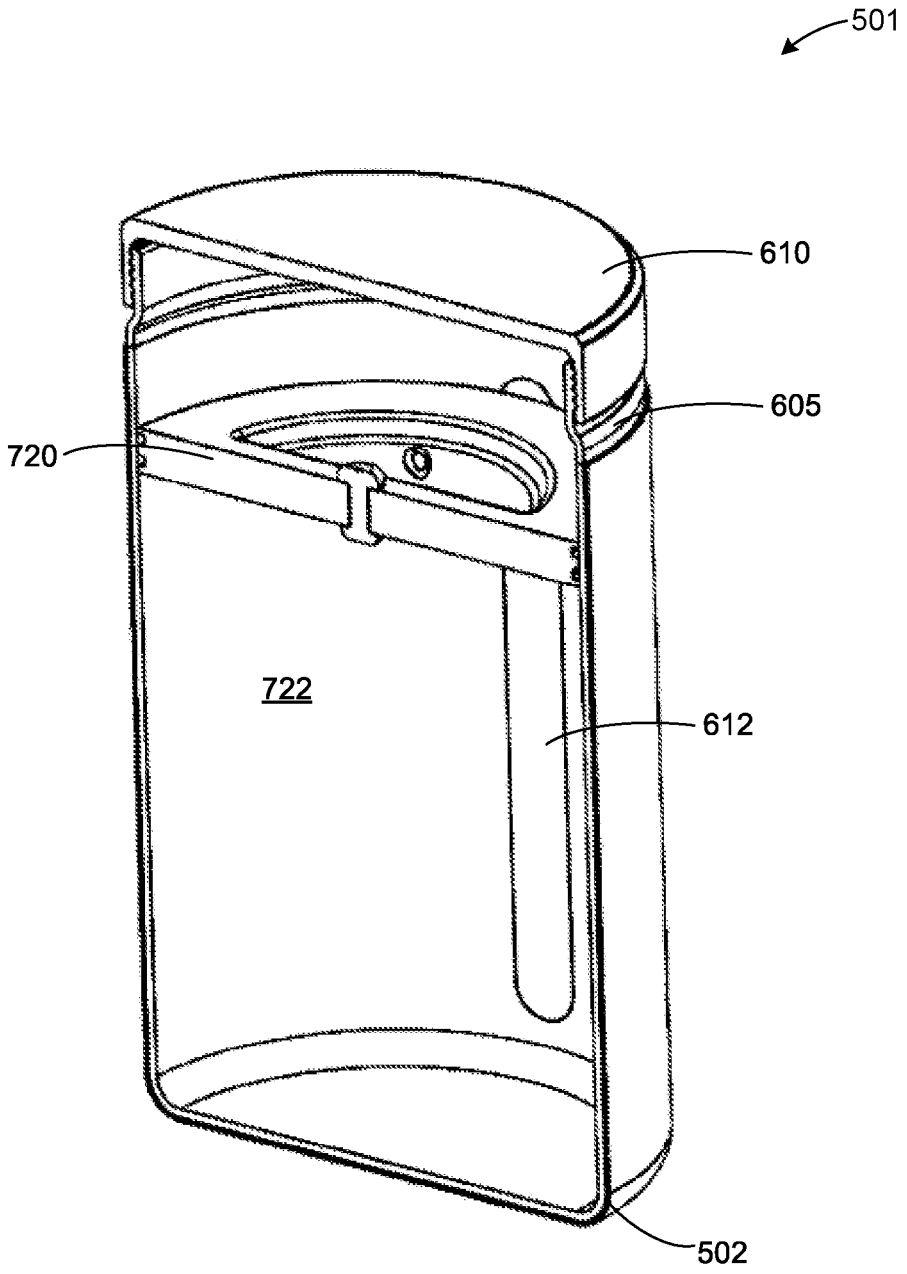
FIG. 7 shows a cross-sectional view of the cannabis container of FIGS. 5-6.

A cross-sectional view of cannabis container 501 is shown at FIG. 7. Shown are portions of bottom 502, top portion 605, and cap 610. Also shown is compressor portion 720. Compressor portion 720 is illustrated as being housed within an interior 722 of cannabis container 501. As can be seen, compressor portion 720 is generally configured with a size and a shape corresponding to an interior dimension of cannabis container 501, such that a circumference of compressor portion 720 abuts up against interior walls of cannabis container 501. In embodiments, compressor portion 720 is comprised of silicone. In embodiments, compressor portion 720 is configured to reduce a volume of air within interior 722 of cannabis container 501. As shown, compressor portion 720 is between bottom 502 and cap 610, under circumstances where cap 610 is attached to top portion 605 of cannabis container 501. Of course, when cap 610 is secured to top portion 605, a user cannot access compressor portion 720 as access would be prevented. Upon removal of cap 610, a user can access compressor portion 720, and via compressor portion 720 can reduce a volume of air within interior 722, particularly the volume of air between bottom 502 and compressor portion 720 of cannabis container 501.

Figure 8:
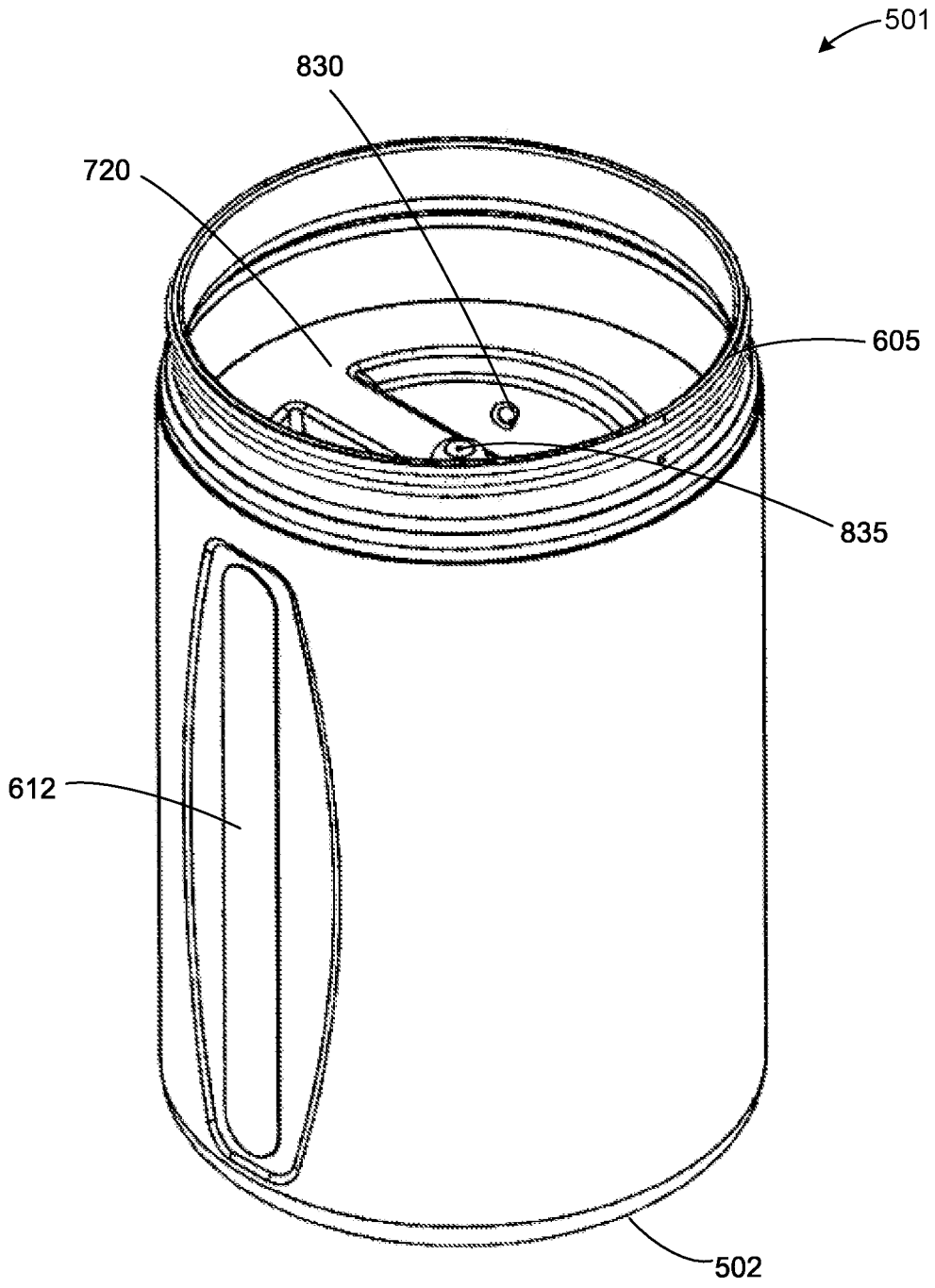
FIG. 8 shows a perspective view of the cannabis container of FIGS. 5-7, without a cap.
Figure 9:
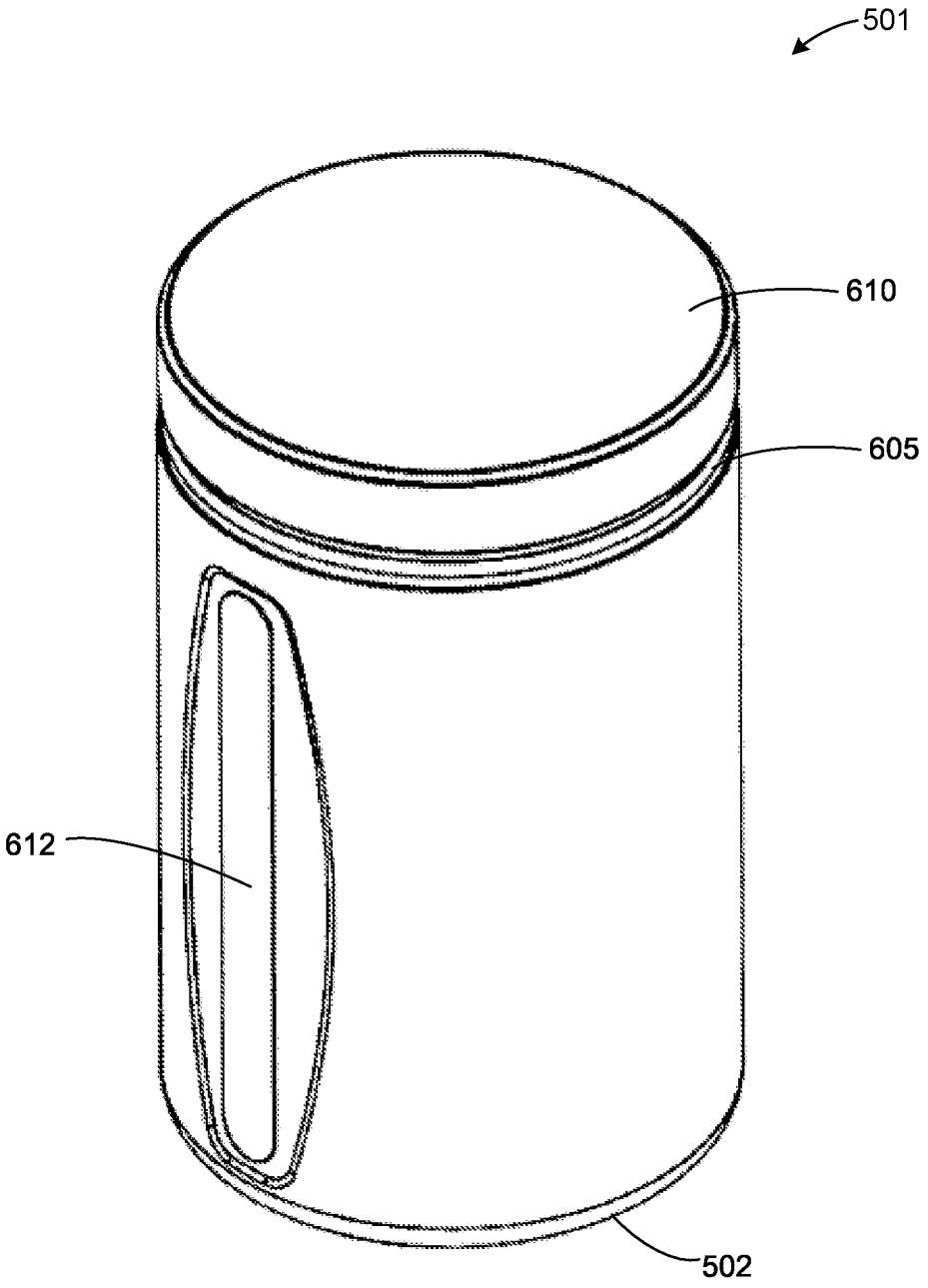
FIG. 9 shows the perspective view of the cannabis container of FIG. 8 with the cap secured to a top portion of the cannabis container.
Figure 10:
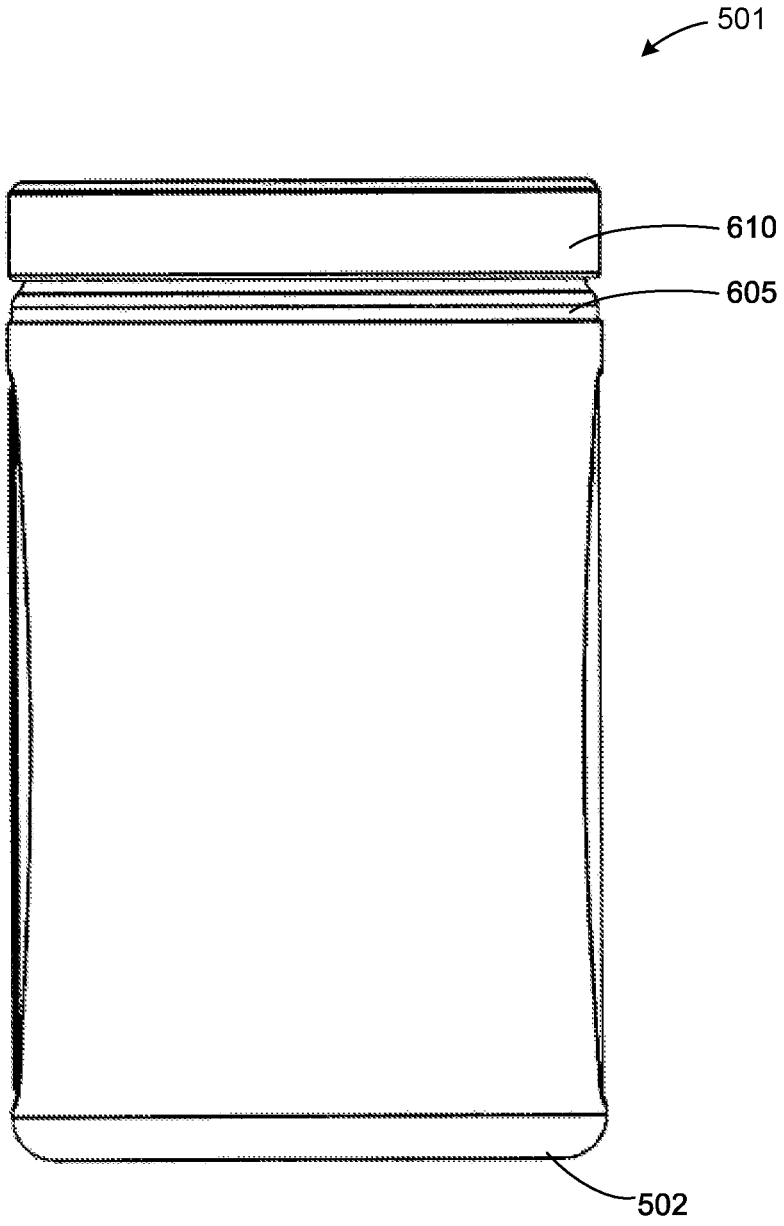
FIG. 10 shows a side view of the cannabis container of FIGS. 5-9.
Figure 15:
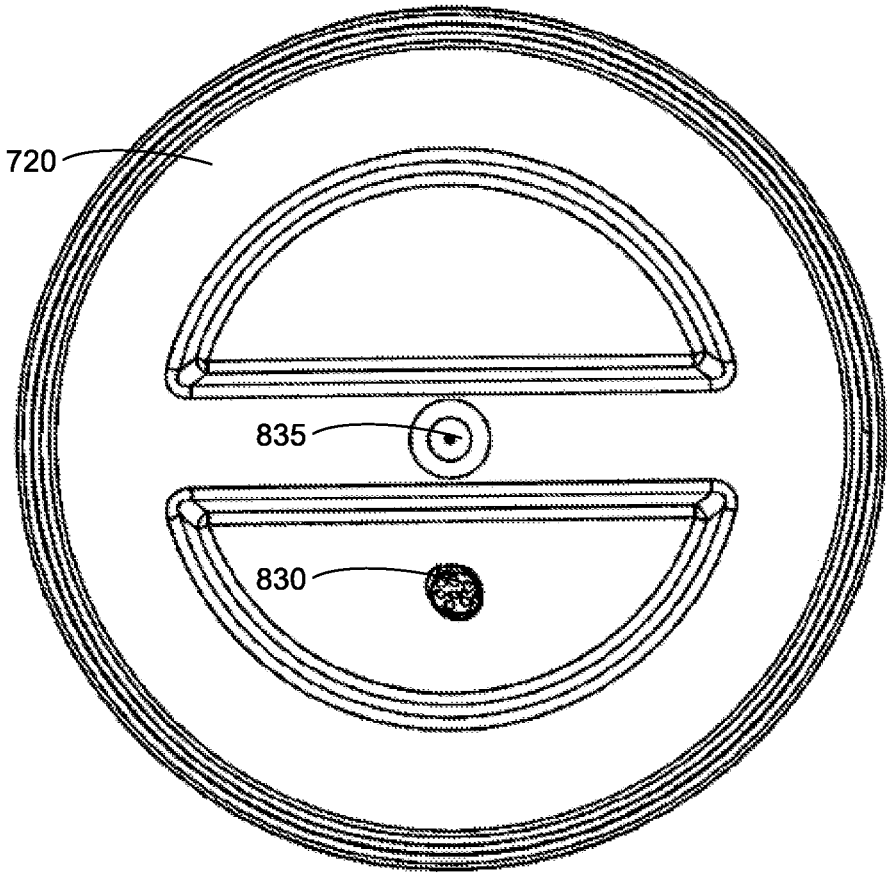
FIG. 15 shows a top view of the cannabis container of FIGS. 5-10, without the cap, illustrating an input pinhole and an output valve.
Figure 16:
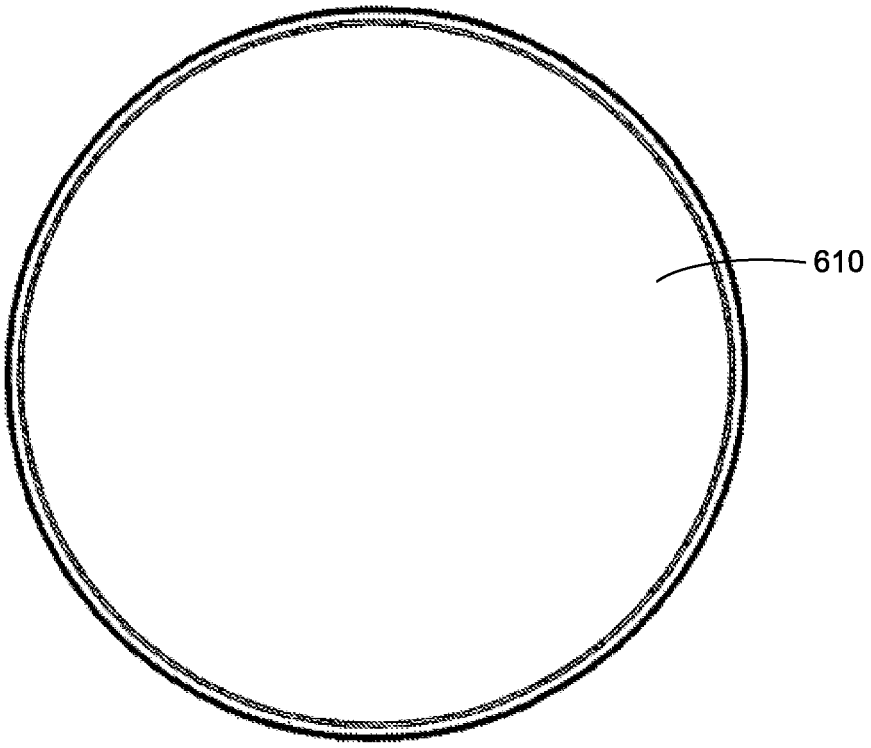
FIG. 16 shows the top view of the cannabis container of FIG. 15 with the cap secured to the top portion of the container.

FIG. 8 depicts a view of cannabis container 501 under circumstances in which the cap (e.g., cap 610) is not attached to top portion 605. As discussed, when top 605 is not attached, a user can access compressor portion 720, in order to reduce the volume of air within the interior of cannabis container 501. As can be seen at FIG. 8, compressor portion 720 includes input pinhole valve 830, and output valve 835. Input pinhole valve 830 can be used for injection of inert gases into the interior of cannabis container 501, for example after the volume of air has been reduced via compressor portion 720. Output valve 835 functions to allow air to be released as compressor portion 720 is used to reduce the volume of air. For reference, FIG. 9 depicts an illustration of cannabis container 501 with cap 610 secured to top portion 605, and FIG. 10 depicts a side-view of cannabis container 501 with cap 610 attached. FIG. 15 depicts an illustration of an isolated view of compressor portion 720 as viewed from a top (i.e., viewed from a top of cannabis container 501 with cap 610 not attached), to illustrate input pinhole valve 830 and output valve 835. FIG. 16 depicts an illustration of cannabis container 501 from a top view, where just top 610 can be seen.

Thus, in embodiments a cannabis container of the present disclosure comprises a cylindrical container (although other shapes are herein contemplated). In embodiments, the container can be comprised of a glass material defining an interior volume for the placement of cannabis. As discussed, the container has a top portion (e.g., top portion 605) configured for the removable receipt of a cap portion (e.g., cap 610). In embodiments, the cap portion can include a locking mechanism to secure the cap portion on the top portion in a child proof manner.

In a preferred embodiment of the present disclosure, the glass material of a cannabis container as herein described is tinted, thus acting as filter to block UV light from entering the container interior. As discussed, cannabis containers of the present disclosure include a compressor portion, generally configured with a size and shape corresponding to the interior dimension of the container, wherein the compressor portion is configured to reduce the volume of air within the container interior. The compressor portion may include an input pinhole configured for the receipt of a needle and hose assembly for the injection of gasses, such as nitrogen, into the interior space of the container. Further, the device includes an internal storage bag for cannabis configured with a porous surface to allow for the transmission of gasses between the bag and container interior. Additionally, the exterior portion of the container may include a temperature gauge (e.g., temperature strip 612) configured to display the storage temperature (i.e., internal temperature) to a user. It will be understood that the device is configured in an assembly that is adaptable to multiple sizes.

Figure 11:
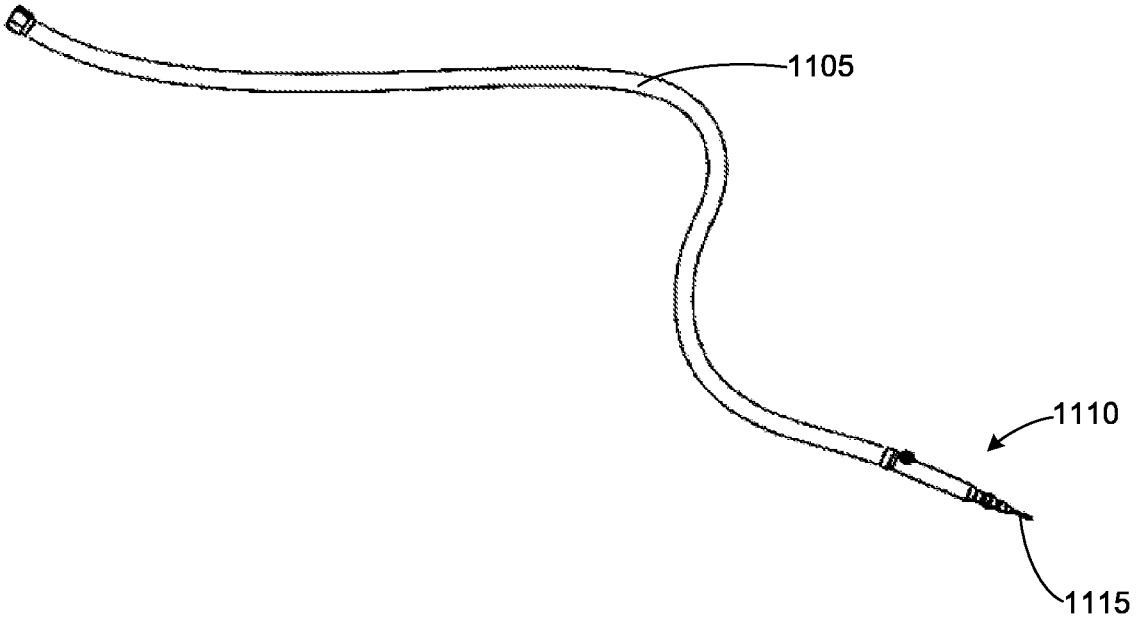
FIG. 11 shows a perspective view of a hose and nozzle capable to deliver inert gas to an interior of the cannabis container of FIGS. 5-9.
Figure 12:
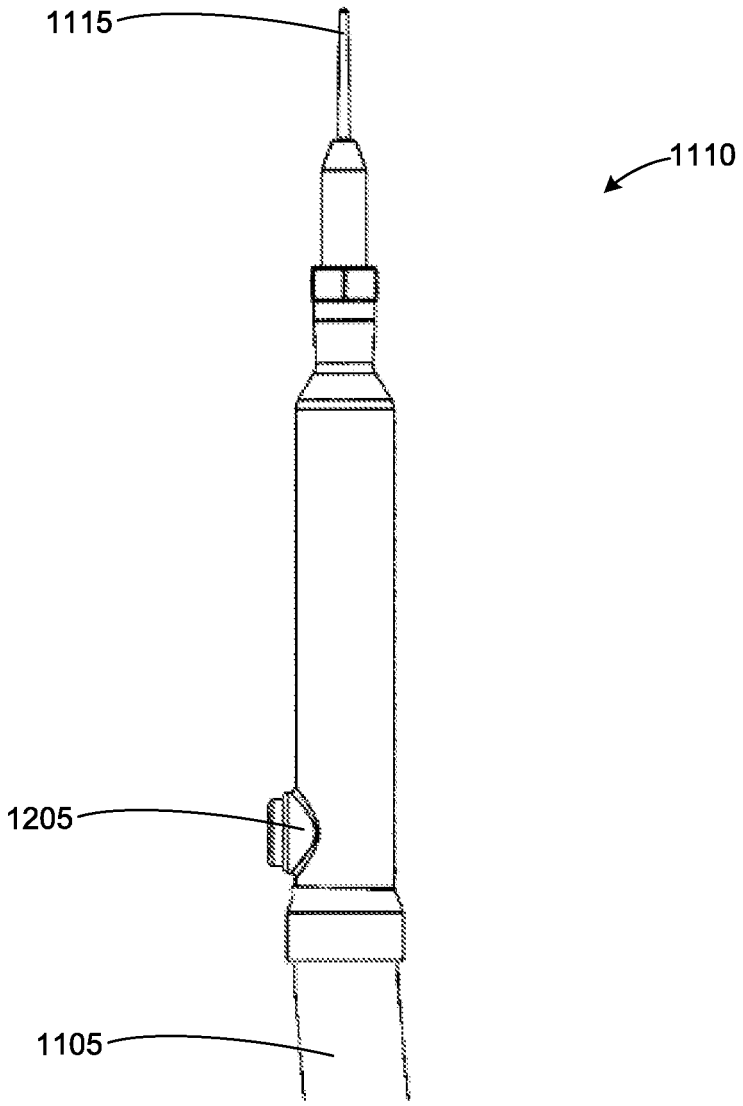
FIG. 12 shows a close-up view of the hose nozzle of FIG. 11.
Figure 13:
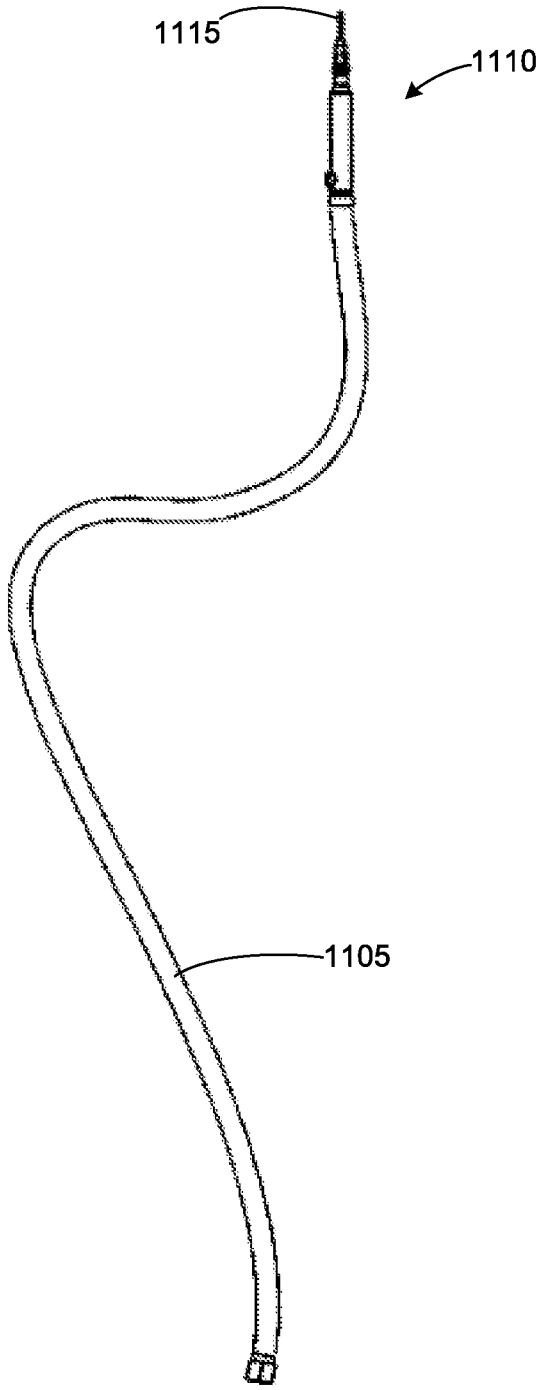
FIG. 13 shows another view of the hose and nozzle of FIG. 11.
Figure 14:
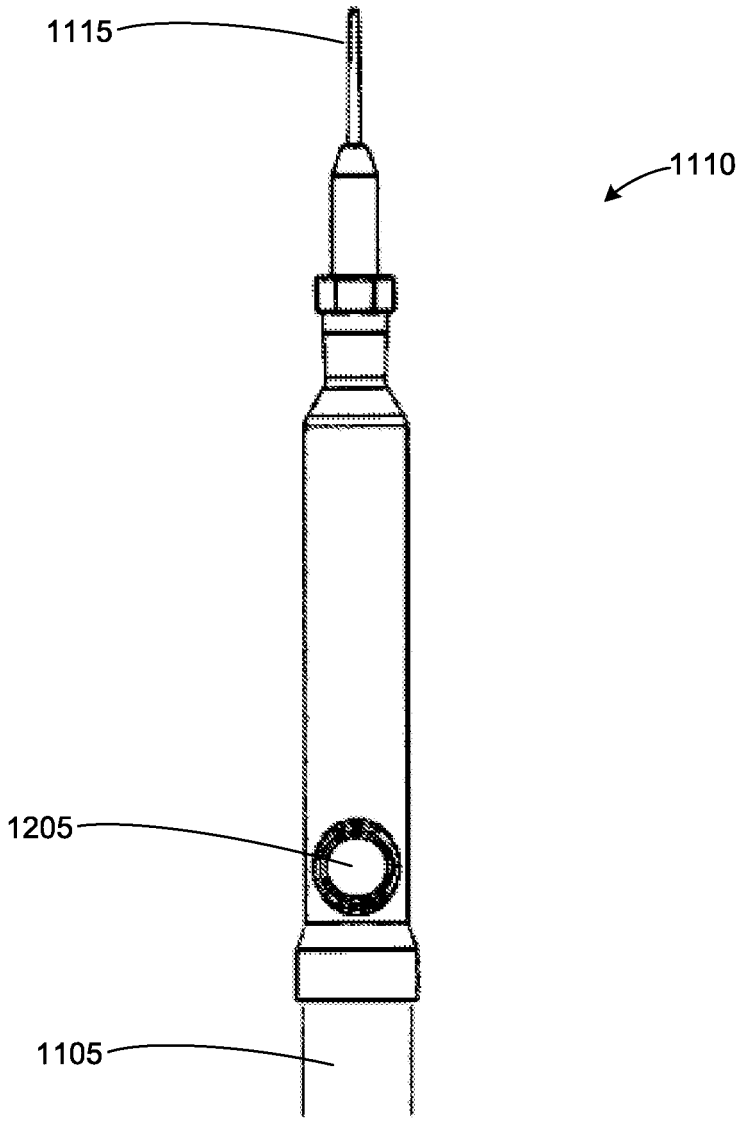
FIG. 14 shows another close-up view of the hose nozzle of FIG. 12 from a different angle.

As discussed, cannabis containers of the present disclosure are capable to receive inert gas injections into an interior space (e.g., between the compressor portion and the bottom), by way of a hose and nozzle configured such that a needle associated with the nozzle can be inserted into the input pinhole (e.g., input pinhole 830) for delivery of inert gas therethrough. Turning to FIG. 11, depicted is an exemplary illustration of such a hose 1105 coupled to nozzle 1110, the nozzle comprising needle 1115. FIG. 12 depicts a close-up view of nozzle 1110 from a side-angle, showing needle 1115, and also depicting actuator 1205 (e.g., knob, push button, etc.) for initiating flow of the inert gas. FIG. 13 depicts another view of the hose 1105 coupled to nozzle 1110, in turn coupled to needle 1115, and FIG. 14 depicts another close-up view of nozzle 1110, to further illustrate actuator 1205.

Various related embodiments of the invention are also described in Appendix A of Provisional Patent Application No. 63/047,866, the disclosure of which is incorporated herein by reference in its entirety.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A cannabis storage apparatus for airtight storage and preservation of cannabis, the apparatus comprising:

a cylindrical glass container that includes a silicone compressor portion of a size and a shape corresponding to an interior dimension of said cylindrical glass container, the compressor portion housed within an interior of the cylindrical glass container and operable to reduce a volume of air within said interior between a bottom of said cylindrical glass container and said compressor portion;

an internal storage bag that is porous to allow for the transmission of gasses therethrough; and wherein said compressor portion further comprises an input pinhole for injection of an inert gas into the interior of said cylindrical glass container between the bottom of said cylindrical glass container and said compressor portion, and an output valve through which air within said interior between the bottom of said cylindrical glass container and said compressor portion can escape as the volume of air is being reduced.

2. The apparatus according to claim 1, wherein the cylindrical glass container further comprises a top portion configured for removable receipt of a cap.

3. The apparatus according to claim 2, wherein said cap comprises a child-proof cap.

4. The apparatus according to claim 1, wherein said cylindrical glass container is tinted for blockage of UV light from entering the interior of said cylindrical glass container.

5. The apparatus according to claim 1, further comprising a temperature strip positioned on an exterior portion of said cylindrical glass container for displaying to a user an internal temperature of said cylindrical glass container.

* * * * *